US005340101A

United States Patent [19]

Lawson et al.

[11] Patent Number: 5,340,101

[45] Date of Patent: Aug. 23, 1994

[54] TRAINING APPARATUS FOR BATTERS

[76] Inventors: Steven R. Lawson, 225 S. Harvey; Raymond J. Lawson, S.R. 2 - 1852 - La. 2, both of Burns, Orêg. 97220

[21] Appl. No.: 131,773

[22] Filed: Oct. 4, 1993

Related U.S. Application Data

[63] Continuation-in-part of Ser. No. 16,158, Feb. 9, 1993, abandoned.

[51] Int. Cl.[5] ..... A63B 69/40

[52] U.S. Cl. ..... 273/26; 273/29 A; 273/58 C; 273/413

[58] Field of Search ..... 273/26 E, 29 A, 413, 273/58 C

[56] References Cited

U.S. PATENT DOCUMENTS

| | | | |
|---|---|---|---|
| 708,573 | 9/1902 | Miles | 273/26 E |
| 2,247,072 | 6/1941 | Stow | 273/29 A |
| 3,475,026 | 10/1969 | Cooper | 273/26 E |
| 3,825,259 | 7/1974 | Burchett | 273/29 A |
| 3,904,199 | 9/1975 | Burchett | 273/29 A |
| 4,322,075 | 3/1982 | Hymes | 273/26 E |
| 4,632,394 | 12/1986 | Ryan | 273/29 A |
| 4,735,413 | 4/1988 | Yamanouchi | 273/26 E |
| 4,966,367 | 10/1990 | Oyarzabal | 273/26 E |
| 5,040,791 | 8/1991 | Ratajac | 273/29 A |
| 5,072,937 | 12/1991 | Zarate | 273/26 E |

*Primary Examiner*—Theatrice Brown

*Attorney, Agent, or Firm*—James D. Givnan, Jr.

[57] ABSTRACT

A training apparatus for baseball players includes an arm assembly for rested engagement with a fence or other support. A brace depends from the arm and engages the fence. An elastic tie-down urges the brace into fence engagement to lock the arm assembly in place. A tether carried by the arm outer end passes through a baseball which is adjustably supported in place along the tether by a cable clamp. The lower end of the tether is anchored in a yieldable manner to a fence component. An elastic member serves to inhibit tether movement. The tether is clamped at its upper end to the arm with an end segment clamped in place to a plate on the arm.

7 Claims, 1 Drawing Sheet

TRAINING APPARATUS FOR BATTERS

BACKGROUND OF THE INVENTION

This patent application is a continuation-in-part application to copending U.S. patent application Ser. No. 08/016,158 filed Feb. 9, 1993 (ABANDONED) by the present inventors.

The present invention pertains generally to apparatuses for the development of the batting skills of baseball players.

The development of batting skills is currently accomplished with the use of costly pitching machines and batting drills utilizing pitchers at some risk to the latter. Hitting practice requires a substantial open area to avoid risk to other players. Accordingly, hitting practice is often limited by lack of space, pitching machines and/or pitchers to throw for batting practice.

Prior art of interest is U.S. Pat. No. 3,825,259 which shows a tethered tennis ball carried by an arm on a fence. U.S. Pat. No. 4,732,382 shows a tennis ball on a rod with a tether and attachable to a chain link fence; U.S. Pat. No. 4,632,394 shows a ball on upper and lower tethers each hooked to a baseball backstop.

SUMMARY OF THE PRESENT INVENTION

The present invention is embodied within an apparatus utilizing a captive baseball yet permitting the practice of hitting same without additional personnel being involved and without risk to others.

The present apparatus includes an arm for attachment to a fence or other upright structure with the arm distal end supporting a length of cable to which is affixed a baseball. The cable is anchored at ground level to the fence or other support and limits ball travel to isolate same from contact with other structure. The arm includes means for rested engagement with the fence and an elastic tie-down for securing the arm to the fence and against loads imparted to the arm. Means for adjusting the height of the tethered baseball are included.

Objectives of the invention include an apparatus for support on a fence to which it may be readily mounted on various structures without tools; the provision of a batter training apparatus which provides a baseball or softball positionable throughout a range of heights; the provision of a baseball hitting training apparatus of compact design manually transported to an installation site and readily installed by the user all without tedious attachment efforts.

DETAILED DESCRIPTION OF THE PREFERRED EMBODIMENTS

Figure 1:
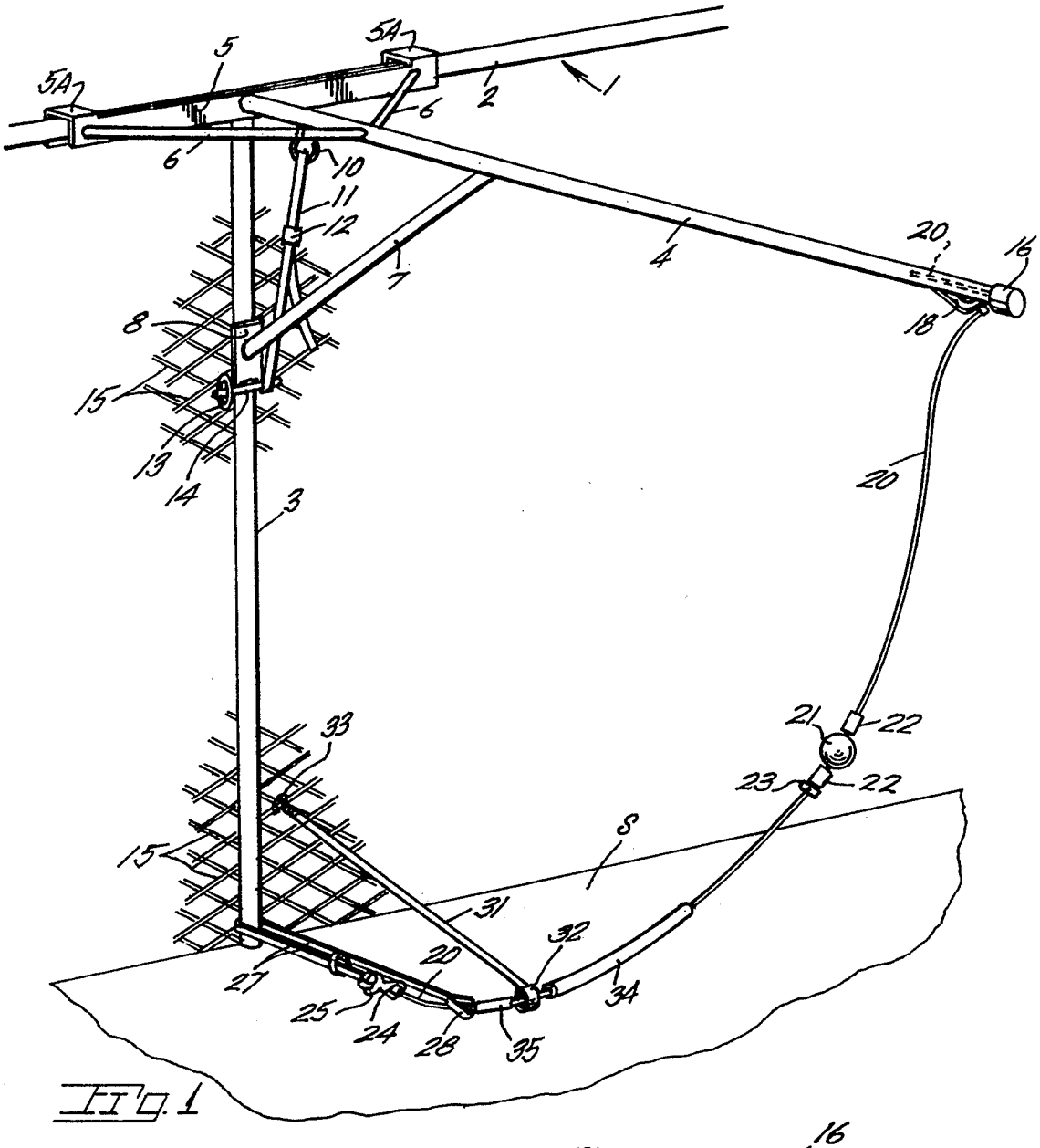
FIG. 1 is a perspective view of the present apparatus.
Figure 2:
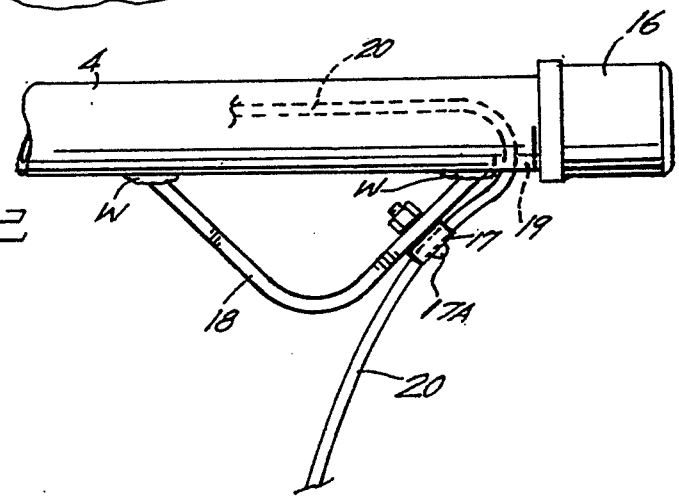
FIG. 2 is a fragmentary view of the arm of the apparatus.

With continuing attention to the drawings wherein applied reference numerals indicate parts similarly hereinafter identified the reference numeral 1 indicates an upright support such as a length of metal fencing F having a top rail 2 and post 3, the latter preferably set in concrete in a ground surface at S. While a fence is shown and described, the present apparatus may be supported on an upright support specifically directed toward use with the present apparatus and which would include counterparts for member 2 and post 3.

With attention now to the present apparatus, the same includes an arm member 4 which terminates in securement at one end with a bracket 5 both comprising parts of an arm assembly which additionally includes side braces 6 and a depending support 7 mounted to the underside of arm 3 and which extends downwardly to receive a plate 8 for abutment with post 3 of a support as at 1. The arm 4 and braces 6 and 7 are preferably tubular for weight reducing purposes. On fences of lesser height than that shown, as for example of four feet in height, the arm 4 may have an upwardly inclined segment. A hook 10 on arm 4 serves to receive the looped end of an adjustable strap 11 equipped with a buckle 12 with the strap extending downwardly for attachment to plate 8 as by a strap mounted ring 13 being in hooked engagement with a rod 14 on plate 8 subsequent to passage of strap 11 through the metal mesh fencing at 15, about post 3 and thence forwardly for ring engagement with rod 14. Hangers at 5A on bracket 5 are open ended for rested engagement with rail 2 of upright support structure 1. The distal end of arm 4 is threaded to receive a cap 16 with the arm end being externally threaded and defining a slot 19. A plate 18 is provided with a cable clamp at 17 with U-bolt 17A provided to secure a ball tether 20 at a desired length to ensure clearance of a later described ball from contact with the upright support. Plate 18 is secured by welds at W.

With attention now to tether 20, the same serves to carry baseball 21 with protective sleeves at 22 positioned along the tether by a limit stop shown as a cable clamp 23. The baseball is apertured to receive tether 20 which extends through a bore in the ball and downwardly to receive a fitting 24 at its end. A snap hook 25 is retained on the tether by fitting 24 and is in hooked engagement with one end of a strap 27 which passes about an anchor which may be fence post 3. Strap 27 projects forwardly and is provided with an eye 28 through which passes a lower end segment of tether 20. To inhibit movement of tether 20, upon a user hitting baseball 21, a bungee 31 includes an eye 32 which receives tether 20 with the remaining end of the bungee provided with a hook 33 for engagement with the upright support which, if a wire fence, the wire fencing as shown. Spacer tubes at 34 and 35 serve to locate the bungee eye 32 along the tether.

In operation the arm assembly is carried to the site of use and installed on upright support 1 with plate 8 being in contact with the support. Strap 11 is tensioned downwardly with the lower end inserted about a component of the upright support and then coupled to the plate 8. Unbuckling of buckle 12 permits tensioning of strap 11. At this point the arm assembly is securely mounted in place on the upright support. The cap 16 may be momentarily removed from the end of arm 4 for inward and outward positioning of tether 20 with outward movement of the tether being prevented by a cable clamp affixed to that part of the tether within the end of the arm. If so desired, the baseball 21 may also be adjusted along tether 20 by raising or lowering cable clamp 23. Protectors 22 isolate the bat from contact with cable clamp 23. The tether lower end is yieldably coupled to an anchor such as fence post 3 by strap 27 which receives the tether mounted snap hook 25. The bungee cord 31 is subsequently engaged with the upright support to limit the travel of ball 21 when hit.

In use the present apparatus may be transported to a practice site by the user who then, without help, couples the apparatus to a fence or other upright support in a convenient manner without the use of tools. Adjustment of the baseball to different positions may be readily accomplished by insertion or extraction of the upper end segment of the tether from arm 4 or the adjustment of limit stop cable clamp 23.

While we have shown but one embodiment of the invention, it will be apparent to those skilled in the art that the invention may be embodied still otherwise without departing from the spirit and scope of the invention.

Having thus described the invention, what is desired to be secured by a Letters Patent is:

We claim:

1. A baseball batting training apparatus for placement on an upright elevated support comprising, an arm asembly including an elongate arm, a bracket at one end of said arm for engagement with said support, a brace on said arm and engageable with the support to support the arm in a substantially horizontal position, tether attachment means at the other end of same arm, tensionable means for coupling said arm and said brace to said support and tensionable to bias the brace toward engagement with said support, a flexible tether terminating at one end of said attachment means and having a ball affixed at a point therealong, and retention means attachable to the support and receiving the remaining end of said tether to limit travel of the remaining end of the tether and the ball on the tether upon the batter hitting the ball.

2. The training apparatus claimed in claim 1 wherein said bracket includes hook shaped members for engagement with the support.

3. The training apparatus claimed in claim 1 wherein said attachment means includes a clamp adjustably engageable with said tether.

4. The training apparatus claimed in claim 1 wherein said tether includes a limit stop limiting travel of said ball along said tether.

5. The training apparatus claimed in claim 1 wherein said retention means includes an elastic cord to yieldably retain said tether when said ball is hit.

6. The training apparatus claimed in claim 1 wherein said retention means includes a strap for attachment to said tether and the support.

7. The training apparatus claimed in claim 1 wherein said retention means includes an elastic cord and a strap.

* * * * *